US012292236B2

(12) United States Patent
Durand et al.

(10) Patent No.: US 12,292,236 B2
(45) Date of Patent: May 6, 2025

(54) REFRIGERATION DEVICE AND SYSTEM

(71) Applicant: L'Air Liquide, Societe Anonyme pour l'Etude et l'Exploitation des Procedes Georges Claude, Paris (FR)

(72) Inventors: Fabien Durand, Sassenage (FR); Guillaume Delautre, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 570 days.

(21) Appl. No.: 17/633,108

(22) PCT Filed: Jul. 8, 2020

(86) PCT No.: PCT/EP2020/069193
§ 371 (c)(1),
(2) Date: Feb. 4, 2022

(87) PCT Pub. No.: WO2021/023459
PCT Pub. Date: Feb. 11, 2021

(65) Prior Publication Data

US 2022/0333859 A1 Oct. 20, 2022

(30) Foreign Application Priority Data

Aug. 5, 2019 (FR) ..... 1908949

(51) Int. Cl.
*F25J 1/02* (2006.01)
*F25B 1/053* (2006.01)
(Continued)

(52) U.S. Cl.
CPC ..... *F25J 1/0296* (2013.01); *F25B 1/053* (2013.01); *F25B 1/10* (2013.01); *F25B 9/06* (2013.01);
(Continued)

(58) Field of Classification Search
CPC ..... F25B 1/10; F25B 11/04; F25B 31/026; F25B 2400/054; F25B 2400/072;
(Continued)

(56) References Cited

U.S. PATENT DOCUMENTS 4,274,849 A * 6/1981 Garier ..... F25J 1/0265 62/612
6,185,960 B1 * 2/2001 Voit ..... F25J 3/04509 62/646
(Continued)

FOREIGN PATENT DOCUMENTS

WO WO 2019/073129 4/2019

OTHER PUBLICATIONS

International Search Report and Written Report for PCT/EP2020/069193, mailed Oct. 23, 2020.
(Continued)

*Primary Examiner* — Ljiljana V. Ciric
(74) *Attorney, Agent, or Firm* — Justin K. Murray

(57) ABSTRACT

A framed, low-temperature refrigeration device is provided, which includes a working circuit that forms a loop and contains a working fluid, the working circuit forming a cycle that includes in series: a compression mechanism, a cooling mechanism, an expansion mechanism and a heating mechanism, wherein the mechanisms for cooling and heating the working fluid include a common heat exchanger in which the working fluid flows in opposite directions in two separate transit portions of the working circuit. The device may also include a refrigeration heat exchanger for extracting heat from at least one member by exchanging heat with the working fluid flowing in the working circuit, wherein the compression mechanism includes two separate compressors, wherein the mechanism for cooling the working fluid includes two cooling heat exchangers which are arranged
(Continued)

respectively at the outlet of the two compressors and ensure heat exchange between the working fluid and a cooling fluid, wherein the frame extends in a longitudinal direction and includes a lower base intended to be mounted on a support, the cooling heat exchangers are located in the frame about the common heat exchanger, i.e. the cooling heat exchangers are not located below the common heat exchanger between the common heat exchanger and the lower base of the frame.

7 Claims, 2 Drawing Sheets

(51) Int. Cl.

| | |
|---|---|
| ***F25B 1/10*** | (2006.01) |
| ***F25B 9/06*** | (2006.01) |
| ***F25B 11/04*** | (2006.01) |
| ***F25B 31/02*** | (2006.01) |
| ***F25J 1/00*** | (2006.01) |

(52) U.S. Cl.
CPC ..... *F25B 11/04* (2013.01); *F25B 31/026* (2013.01); *F25J 1/001* (2013.01); *F25J 1/0022* (2013.01); *F25J 1/0025* (2013.01); *F25J 1/005* (2013.01); *F25J 1/0062* (2013.01); *F25J 1/0065* (2013.01); *F25J 1/0067* (2013.01); *F25J 1/0072* (2013.01); *F25J 1/0204* (2013.01); *F25J 1/0212* (2013.01); *F25J 1/0258* (2013.01); *F25J 1/0259* (2013.01); *F25J 1/0261* (2013.01); *F25J 1/0265* (2013.01); *F25J 1/0277* (2013.01); *F25J 1/0284* (2013.01); *F25J 1/0288* (2013.01); *F25B 2400/054* (2013.01); *F25B 2400/072* (2013.01); *F25B 2400/14* (2013.01); *F25B 2500/01* (2013.01); *F25B 2600/0251* (2013.01); *F25J 2230/04* (2013.01); *F25J 2230/20* (2013.01); *F25J 2290/34* (2013.01); *F25J 2290/62* (2013.01)

(58) Field of Classification Search
CPC ..... F25B 2400/14; F25B 2600/0251; F25B 1/053; F25B 9/06; F25B 2500/01; F25J 1/001; F25J 1/0022; F25J 1/0025; F25J 1/005; F25J 1/0062; F25J 1/0065; F25J 1/0067; F25J 1/0072; F25J 1/0204; F25J 1/0212; F25J 1/0258; F25J 1/0259; F25J 1/0261; F25J 1/0265; F25J 1/0277; F25J 1/0284; F25J 1/0288; F25J 2230/04; F25J 2230/20; F25J 2290/34; F25J 1/0296; F25J 2290/62
See application file for complete search history.

(56) References Cited

U.S. PATENT DOCUMENTS

| | | | | |
|---|---|---|---|---|
| 10,343,890 | B1 * | 7/2019 | Kaufman | F25J 1/0221 |
| 10,384,926 | B1 * | 8/2019 | Kaufman | F25J 1/0236 |
| 11,815,295 | B2 * | 11/2023 | Durand | F25J 1/0261 |
| 12,038,215 | B2 * | 7/2024 | Durand | F25B 31/026 |
| 2012/0291434 | A1 | 11/2012 | Janssens | |
| 2018/0087809 | A1 | 3/2018 | Jeda et al. | |
| 2019/0086147 | A1 * | 3/2019 | Brown, III | F25J 1/0231 |
| 2020/0300510 | A1 | 9/2020 | Durand | |
| 2022/0333859 | A1 * | 10/2022 | Durand | F25J 1/0072 |

OTHER PUBLICATIONS

French Search Report for FR 1 908 949, mailed Apr. 3, 2020.
"Brayton Closed Cycle Gas Turbine Study for LNG Reliquefaction System," Shipping World & Shipbuilding, vol. 166, No. 3887, Nov. 1, 1973, pp. 1199-1200.

* cited by examiner

[Fig. 1]
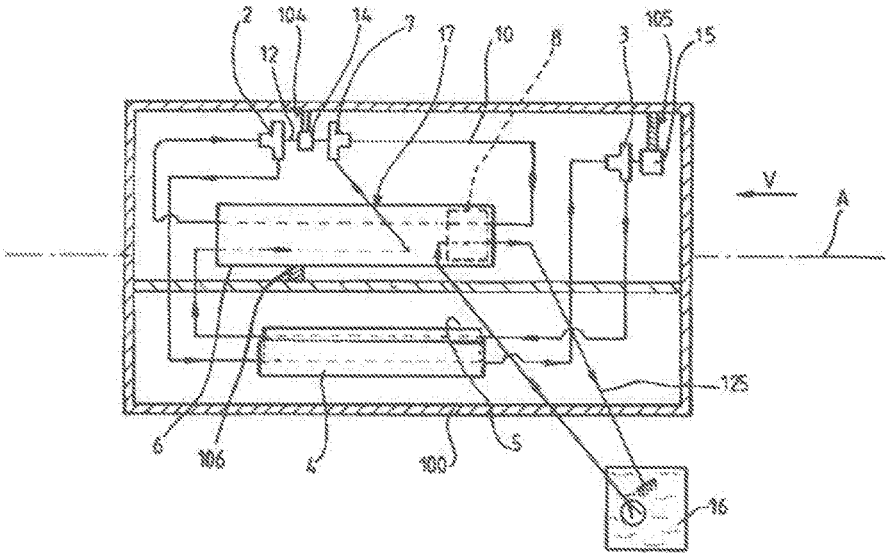
[Fig. 2]
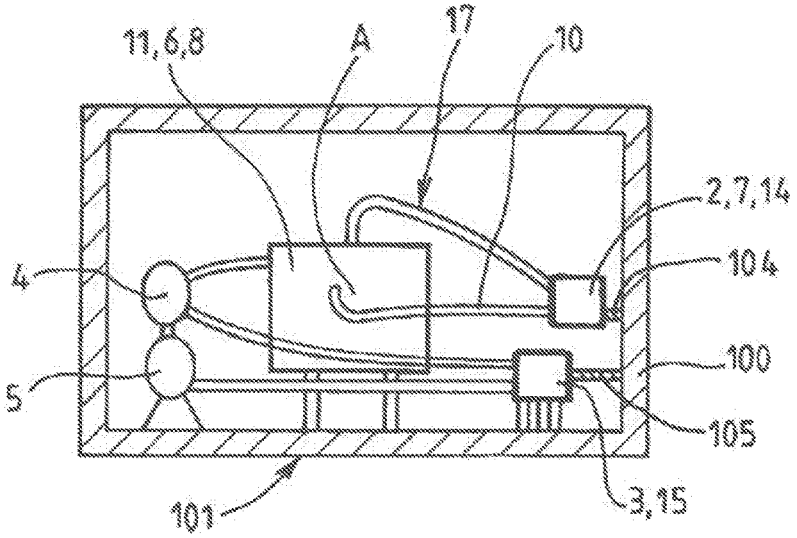

[Fig. 3]
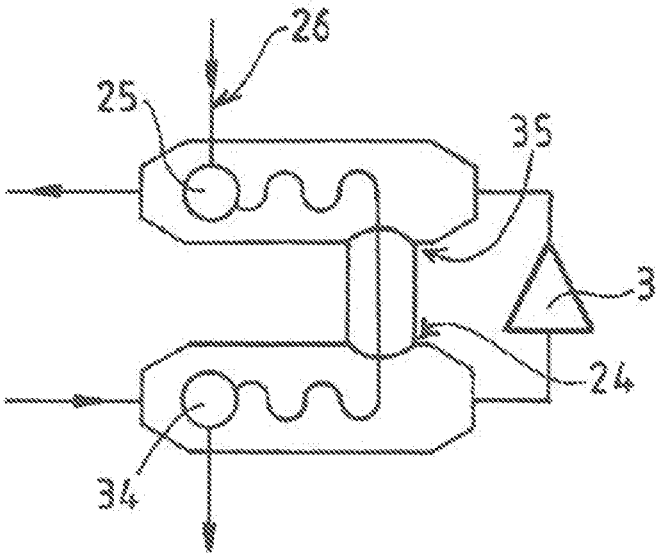

REFRIGERATION DEVICE AND SYSTEM

CROSS-REFERENCE TO RELATED APPLICATIONS

This application is a § 371 of International PCT Application PCT/EP2020/069193, filed Jul. 8, 2020, which claims § 119(a) foreign priority to French patent application FR 1908949, filed Aug. 5, 2019.

BACKGROUND

Field of the Invention

The invention relates to a device and a system for refrigeration.

The invention relates more particularly to a low-temperature refrigeration device, that is to say for refrigeration at a temperature of between minus 100 degrees centigrade and minus 273 degrees centigrade, the refrigeration device being disposed in a frame and comprising a working circuit forming a loop and containing a working fluid, the working circuit forming a cycle that comprises, in series: a mechanism for compressing the working fluid, a mechanism for cooling the working fluid, a mechanism for expanding the working fluid, and a mechanism for heating the working fluid, the mechanisms for cooling and heating the working fluid comprising a common heat exchanger through which the working fluid passes in countercurrent in two separate passage portions of the working circuit depending on whether it is cooled or heated, the device comprising a refrigeration heat exchanger intended to extract heat at at least one member by heat exchange with the working fluid circulating in the working circuit, the compression mechanism comprising two separate compressors, the mechanism for cooling the working fluid comprising two cooling heat exchangers that are disposed respectively at the outlets of the two compressors and ensure heat exchange between the working fluid and a cooling fluid, the frame extending in a longitudinal direction and comprising a lower base intended to be fixed to a support.

Related Art

The term low-temperature refrigeration device denotes a refrigeration device that reaches a temperature of between minus 100 degrees centigrade and minus 273 degrees centigrade, in particular between minus 100 degrees centigrade and minus 253 degrees centigrade (20K).

The invention relates in particular to cryogenic refrigerators and/or liquefiers, for example of the type having a "Turbo Brayton" cycle or "Turbo Brayton coolers" in which a working gas, also known as cycle gas (helium, nitrogen, hydrogen or another pure gas or a mixture), undergoes a thermodynamic cycle producing cold which can be transferred to a member or a gas intended to be cooled.

These devices are used in a wide variety of applications and in particular for cooling natural gas in a tank (for example in ships). The liquefied natural gas is for example subcooled to avoid vaporization thereof or the gaseous part is cooled in order to be reliquefied.

For example, a flow of natural gas can be made to circulate in a heat exchanger cooled by the cycle gas of the refrigerator/liquefier.

These devices may comprise a plurality of heat exchangers interposed at the outlets of the compression stages. These devices are incorporated in a surround or frame, the volume of which is limited. It is thus difficult to incorporate these various exchangers and associated pipes. The cooling of the working gas may be problematic in some cases.

Moreover, when these devices are installed in ships (methane tankers for example), the device is subjected to the forces generated by roll and pitch. Certain imbalances may bring about detrimental mechanical stresses.

SUMMARY OF THE INVENTION

An aim of the present invention is to overcome all or some of the drawbacks of the prior art that are set out above, preferably as claimed in claim 1.

To this end, the device according to the invention, which is otherwise in accordance with the generic definition thereof given in the above preamble, is essentially characterized in that the cooling heat exchangers are situated in the frame around the common heat exchanger, meaning preferably that the cooling heat exchangers are not situated beneath the common heat exchanger between the common heat exchanger and the lower base of the frame.

Furthermore, embodiments of the invention may include one or more of the following features:

- the cooling heat exchangers are situated in the frame next to the common heat exchanger in a direction transverse to the longitudinal axis,
- the cooling heat exchangers are situated adjacently, that is to say in a manner spaced apart from one another by a distance of between 0 and 500 mm, in particular between 100 and 300 mm,
- the two cooling heat exchangers are disposed one above the other in a direction perpendicular to the base,
- the cooling heat exchangers each have an elongate shape extending in respective longitudinal directions,
- each cooling heat exchanger comprises an inlet for working gas to be cooled and an outlet for cooled working gas that are disposed respectively at two longitudinal ends, each cooling heat exchanger comprising an inlet for cooling fluid and an outlet for cooling fluid, the two cooling heat exchangers being arranged inversely with respect to one another, meaning that the respective longitudinal directions of the two cooling heat exchangers are parallel or substantially parallel and the directions of circulation of the working fluid in said cooling heat exchangers are opposite to one another,
- each cooling heat exchanger comprises an inlet for working gas to be cooled and an outlet for cooled working gas that are disposed respectively at two longitudinal ends, each cooling heat exchanger comprising an inlet for cooling fluid and an outlet for cooling fluid, the two cooling heat exchangers being arranged inversely with respect to one another, meaning that the respective longitudinal directions of the two cooling heat exchangers are parallel or substantially parallel and the directions of circulation of the working fluid in said cooling heat exchangers are opposite to one another,
- the outlet for cooling fluid of one of the cooling heat exchangers is connected to the inlet for cooling fluid of the other cooling heat exchanger such that some of the flow of cooling fluid passing through one of the cooling heat exchangers has already circulated in the other cooling heat exchanger,
- the two compressors are disposed in series in the working circuit,
- the device comprises at least two drive motors for rotating the compressors, each comprising a rotary drive shaft, the compressors being driven in rotation by the respective rotary shaft(s), the mechanism for expanding the working fluid comprising at least one rotary turbine that rotates conjointly with a shaft of one of the drive motors of at least one compressor, the refrigeration capacity of the refrigeration device being variable and controlled by a controller that regulates the speed of rotation of the drive motor(s), the coolant circuit supplies cooling fluid first of all to the first cooling heat exchanger in series in the direction of circulation of the working fluid, and then the second cooling heat exchanger in series in the direction of circulation of the working fluid is supplied with cooling fluid that has passed through the first cooling heat exchanger, the coolant circuit supplies cooling fluid first of all to the second cooling heat exchanger in series in the direction of circulation of the working fluid, the first cooling heat exchanger in series in the direction of circulation of the working fluid being supplied with cooling fluid that has passed through the second cooling heat exchanger.

The invention also relates to a system for refrigeration and/or liquefaction of a flow of user fluid, in particular natural gas, comprising a refrigeration device according to any one of the features above or below, the system comprising at least one tank of user fluid, and a duct for circulation of said flow of user fluid in the cooling exchanger.

The invention may also relate to any alternative device or method comprising any combination of the features above or below within the scope of the claims.

BRIEF DESCRIPTION OF THE FIGURES

Further particular features and advantages will become apparent upon reading the following description, which is given with reference to the figures, in which:

FIG. 1 shows a schematic and partial top view illustrating the structure and operation of an example of a device and a system that can implement the invention, FIG. 2 shows a schematic and partial side view along the arrow V in FIG. 1 illustrating details of the structure and of the operation of the device, FIG. 3 shows a schematic and partial view illustrating a detail of the structure and of the operation of the device and of the system according to one possible embodiment variant of the arrangement of two cooling heat exchangers.

DETAILED DESCRIPTION OF THE INVENTION

The cooling and/or liquefaction system comprises a refrigeration device 1 that supplies cold (a cooling capacity) at a refrigeration heat exchanger 8.

The device is housed in a frame 100, for example a parallelepipedal frame. The frame 100 comprises a lower base 101.

In contrast to the depiction in FIG. 2, the upper end of the frame does not necessarily have a structure above the device but could have only peripheral struts, the vertical ends of which are situated vertically above the base 101 at or below the highest point of the device. This means that the frame 100 could form lateral protection all around the device while not having the upper part vertically above the device.

The system comprises a duct 125 for circulation of a flow of fluid to be cooled placed in heat exchange with this cooling exchanger 8. For example, the fluid is liquid natural gas pumped from a tank 16 (for example via a pump), then cooled (preferably outside the tank 16), then returned to the tank 16 (for example raining down in the gas phase of the tank 16). This makes it possible to cool or subcool the contents of the tank 16 and to limit the occurrence of vaporization. For example, the liquid from the tank 16 is subcooled below its saturation temperature (drop in its temperature of several degrees K, in particular 5 to 20K and in particular 14K) before being reinjected into the tank 16. In a variant, this refrigeration can be applied to the vaporization gas from the tank in order in particular to reliquefy it. This means that the refrigeration device 1 produces a cold capacity at the refrigeration heat exchanger 8.

The refrigeration device 1 comprises a working circuit 10 (preferably closed) forming a circulation loop. This working circuit 10 contains a working fluid (helium, nitrogen, neon, hydrogen or another appropriate gas or mixture, for example helium and argon or helium and nitrogen or helium and neon or helium and nitrogen and neon).

The working circuit 10 forms a cycle comprising: a mechanism 2, 3 for compressing the working fluid, a mechanism 4, 5, 6 for cooling the working fluid, a mechanism 7 for expanding the working fluid, and a mechanism 6 for heating the working fluid.

The device 1 comprises a refrigeration heat exchanger 8 situated downstream of the expansion mechanism 7 and intended to extract heat at at least one member 125 by heat exchange with the cold working fluid circulating in the working circuit 10.

The mechanisms for cooling and heating the working fluid conventionally comprise a common heat exchanger 6 through which the working fluid passes in countercurrent in two separate passage portions of the working circuit 10 depending on whether it is cooled or heated.

The common heat exchanger 6 may be fixed to the frame at at least one fixed point 106, for example at a central longitudinal strut of the frame 100.

The cooling heat exchanger 8 is situated for example between the expansion mechanism 7 and the common heat exchanger 6. As illustrated, the cooling heat exchanger 8 may be a heat exchanger incorporated into the common heat exchanger 6 (meaning that the two exchangers 6, 8 can be in one piece, i.e. may have separate fluid circuits that share one and the same exchange structure, however). However, in a variant, this refrigeration heat exchanger 8 could be made up of a heat exchanger different than and separate from the common heat exchanger 6.

Thus, the working fluid which leaves the compression mechanism 2, 3 in a relatively hot state is cooled in the common heat exchanger 6 before entering the expansion mechanism 7. The working fluid which leaves the expansion mechanism 7 and the cooling heat exchanger 8 in a relatively cold state is, for its part, heated in the common heat exchanger 6 before returning into the compression mechanism 2, 3 in order to start a new cycle.

The compression mechanism 2, 3 comprises at least two compressors and at least one drive motor 14, 15 for the compressors 2, 3. In addition, preferably, the refrigeration capacity of the device is variable and can be controlled by regulating the speed of rotation of the drive motor(s) 14, 15 (cycle speed). Preferably, the cold capacity produced by the device 1 can be adapted by 0 to 100% of a nominal or maximum capacity by changing the speed of rotation of the motor(s) 14, 15 between a zero speed of rotation and a maximum or nominal speed. Such an architecture makes it possible to maintain a high performance level over a wide operating range (for example 97% of nominal performance at 50% of the nominal cold capacity).

In the nonlimiting example shown, the refrigeration device 1 comprises two compressors 2, 3 in series. These two compressors 2, 3 may be driven respectively by two separate motors 14, 15. A turbine 7 may be coupled to the drive shaft of one of the two motors 14 or 15. For example, a first motor 14 drives a compressor 2 by way of a shaft and this shaft is coupled to a turbine 7 at its other end (motor-turbocompressor) while the other motor 15 drives only a compressor 3 (motor-compressor).

For example, the device 1 comprises two high-speed motors 14, 15 (for example 10 000 revolutions per minute or several tens of thousands of revolutions per minute) for respectively driving the compression stages 2, 3. The turbine 7 may be coupled to the motor 14 or 15 of one of the compression stages 2, 3, meaning that the device may have a turbine 7 forming the expansion mechanism which is coupled to the drive motor 15 of a compression stage (the first or the second).

As illustrated, each motor 14, 15 may be connected or fixed rigidly to the frame 100 via at least one fixed point 104, 105, for example at a longitudinal and/or vertical strut of the frame 100.

Thus, the power of the turbine(s) 7 can advantageously be recovered and used to reduce the consumption of the motor(s). Thus, by increasing the speed of the motors (and thus the flow rate in the cycle of the working gas), the refrigeration capacity produced and thus the electrical consumption of the liquefier are increased (and vice versa). The compressors 2, 3 and turbine(s) 7 are preferably coupled directly to an output shaft of the motor in question (without a geared movement transmission mechanism).

The output shafts of the motors are preferably mounted on bearings of the magnetic type or of the dynamic gas type. The bearings are used to support the compressors and the turbines.

In the example depicted, the refrigeration device 1 comprises two compressors 2, 3 that form two compression stages and an expansion turbine 7. This means that the compression mechanism comprises two compressors 2, 3 in series, preferably of the centrifugal type, and the expansion mechanism comprises a single turbine 7, preferably a centripetal turbine. Of course, any other number and arrangement of compressor(s), turbine(s) and motor(s) may be envisioned, for example: three compressors driven respectively by three separate motors and a turbine for example coupled to one end of the drive shaft of one of these motors, or three compressors and two turbines. Similarly, the device may comprise two compressors and two turbines or three compressors and three turbines, etc. The drive shaft of each motor drives, at one end, at least one compressor, while the other end of the shaft does not have a wheel (compressor or turbine) or comprises one or more wheels (turbine or compressor).

As illustrated, a cooling heat exchanger 4, 5 is provided at the outlet of each of the two compressors 2, 3 (for example cooling by heat exchange with water at ambient temperature or any other cooling agent or fluid of a coolant circuit 26; cf. [FIG. 3]).

This makes it possible to realize isentropic or isothermal or substantially isothermal compression. Similarly, a heating exchanger may or may not be provided at the outlet of all or part of the expansion turbines 7 to realize isentropic or isothermal expansion. Also preferably, the heating and cooling of the working fluid are preferably isobaric, without this being limiting.

The frame 100 extends in a longitudinal direction A and comprises a lower base 101 intended to be fixed to a support (for example the ground or a floor of a ship or the top of a tank 16 of liquid to be cooled for example). This base may be formed of rigid struts that delimit a rectangle provided with longitudinal and transverse struts.

As illustrated in [FIG. 2], at least a part of the elements of the device may be fixed to this base 101, in particular a box structure accommodating the common heat exchanger 6 and the refrigeration exchanger 8.

As can be seen by way of example in [FIG. 2], the cooling heat exchangers 4, 5 are not situated beneath the common heat exchanger 6 between the common heat exchanger 6 and the lower base 101 of the frame 100, but these cooling heat exchangers 4, 5 are situated in the frame 100 around the common heat exchanger 6. The inventors have found that this arrangement ensures a distribution of the masses that improves the integrity of the device with respect to forces in particular when the device is mounted on a mobile machine, in particular a ship. Specifically, this arrangement allows a better distribution of the masses as close as possible to the base 101.

Moreover, the duct or portion 17 of the working circuit connecting an outlet of the common heat exchanger 6 to the inlet of the turbine 7 is connected thereto in the upper part of the device 1. The casing or cold box (for example insulated under vacuum) accommodating the common heat exchanger 6 and the refrigeration exchanger 8 may be fixed as close as possible to the base 101.

This further improves the distribution of the masses of the device and of the acceleration forces.

As illustrated, the two cooling heat exchangers 4, 5 may each have an elongate shape extending in respective longitudinal directions that are parallel to the longitudinal axis A. The two cooling heat exchangers 4, 5 may advantageously be disposed one above the other in a perpendicular direction. The two cooling heat exchangers 4, 5 may in particular be alongside and fixed to one another. This optimizes the space requirement of the device.

Each cooling heat exchanger 4, 5 may comprise an inlet 24, 25 for cooling fluid and an outlet 34, 35 for cooling fluid. According to an advantageous particular feature, the outlet 34 for cooling fluid of one of the two cooling heat exchangers 4, 5 may be connected to the inlet 25 for cooling fluid of the other cooling heat exchanger 5 such that some of the flow of cooling fluid passing through one 5 of the cooling heat exchangers has already circulated in the other cooling heat exchanger 4 (cf. [FIG. 3]).

This allows the two cooling heat exchangers 4, 5 to receive 100% of a flow of cooling fluid (rather than subdividing this flow into two halves distributed respectively in the two exchangers 4, 5).

This relative increase in the cooling fluid flow rate thus makes it possible to increase the coefficient of heat exchange and therefore improves the quality and the reliability of cooling. Moreover, this solution makes it possible to avoid problems inherent to the known solution in which two flow rates can diverge within the two heat exchangers (on account in particular of pressure drops which may vary from one circuit or exchanger to the other).

This arrangement also makes it possible to simplify the network of ducts for cooling fluid and working gas heading toward the heat exchangers 4, 5 or coming from the heat exchangers 4, 5. In particular, this arrangement makes it more easily possible to arrange the circulation circuits for the fluids (cooling fluid and working fluid) in a smaller space while allowing countercurrent circulations between the working fluid and the cooling fluid, by reducing the number and/or the length of the ducts transporting these fluids.

As shown in [FIG. 3], for example the coolant circuit 26 supplies cooling fluid first of all to the second cooling heat exchanger 5 and then to the first cooling heat exchanger 8 (the qualifiers "first" and "second" referring to the first and second compression stages in the direction of circulation of the working fluid).

Of course, the opposite arrangement may be envisioned (circulation of the cooling fluid first of all in the first heat exchanger 4 and then in the second heat exchanger 5).

As illustrated, in both cases, the directions of circulation of the two fluids (working fluid to be cooled and relatively colder cooling fluid) pass preferably in countercurrent or in opposite directions through each exchanger.

As illustrated in [FIG. 3], the fluidic connection between the two cooling heat exchangers 4, 5 for the passage of the cooling fluid may be simplified and smaller. This transfer of cooling fluid from one cooling exchanger 4, 5 to the other may in particular be realized by a short and welded portion of tube, or a simple tube or connector between the two heat exchangers 4, 5.

If necessary, the two cooling heat exchangers 4, 5 could even be incorporated in one and the same casing or housing comprising two separate passages for the circulation of the working fluid, said two passages being in heat exchange respectively with two portions in series of one and the same circulation channel of the cooling fluid circuit.

For example, the cooling heat exchangers 4, 5 may each have an elongate shape extending in a respective longitudinal direction. Each cooling heat exchanger 4, 5 comprises an inlet for working gas to be cooled and an outlet for cooled working gas that are disposed respectively at two longitudinal ends.

The cooling heat exchangers 4, 5 may be exchangers of the tube type, of the shell and tube type, or of the plate and fin type (made of stainless steel, aluminum or the like).

Moreover, the two cooling heat exchangers 4, 5 are arranged within the device preferably inversely with respect to one another, meaning that the respective longitudinal directions of the two cooling heat exchangers 4, 5 are parallel or substantially parallel and the directions of circulation of the working fluid in said cooling heat exchangers 4, 5 are opposite to one another. This arrangement combined with the arrangement of the circulation of the cooling fluid makes it possible to minimize the complexity of the fluidic circuits while conferring very good performance on the device.

All or part of the device, in particular the cold members thereof, can be accommodated in a thermally insulated sealed casing 11 (in particular a vacuum chamber containing the common countercurrent heat exchanger and the refrigeration exchanger 8).

The invention may apply to a method for cooling and/or liquefying another fluid or mixture, in particular hydrogen.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A low-temperature refrigeration device for refrigeration at a temperature of between minus 100 degrees centigrade and minus 273 degrees centigrade, the refrigeration device being disposed in a frame and comprising:

a working circuit forming a loop and containing a working fluid, the working circuit forming a cycle that comprises, in series: a compression mechanism for compressing the working fluid, a cooling mechanism for cooling the working fluid, an expansion mechanism for expanding the working fluid, and a heating mechanism for heating the working fluid, wherein:

the cooling and heating mechanisms comprising a common heat exchanger through which the working fluid passes in countercurrent in two separate passage portions of the working circuit depending on whether the user fluid is cooled or heated;

the compression mechanism comprises two separate compressors;

the cooling mechanism comprises two cooling heat exchangers that are disposed respectively at the outlets of the two compressors and ensure heat exchange between the working fluid and a cooling fluid;

the frame extends in a longitudinal direction and comprises a lower base configured to be fixed to a support;

the cooling heat exchangers are situated in the frame;

the cooling heat exchangers each have an elongate shape extending in respective longitudinal directions;

each cooling heat exchanger comprises an inlet for working gas to be cooled and an outlet for cooled working gas that are disposed respectively at two longitudinal ends;

each cooling heat exchanger comprises an inlet for cooling fluid and an outlet for cooling fluid;

the two cooling heat exchangers are arranged inversely with respect to one another such that the respective longitudinal directions of the two cooling heat exchangers are parallel or substantially parallel and the directions of circulation of the working fluid in said cooling heat exchangers are opposite to one another;

the cooling heat exchangers are situated adjacently spaced apart from one another by a distance of between 0 mm and 500 mm;

the cooling heat exchangers of elongate shape extend in longitudinal directions that are parallel to the longitudinal axis;

the outlet for cooling fluid of one of the cooling heat exchangers is connected to the inlet for cooling fluid of the other cooling heat exchanger such that some of the flow of cooling fluid passing through one of the cooling heat exchangers has already circulated in the other cooling heat exchanger; and a refrigeration heat exchanger intended to extract heat at at least one member by heat exchange with the working fluid circulating in the working circuit, wherein the two cooling heat exchangers are disposed side-by-side or one above the other in a direction perpendicular to the base, wherein a direction of circulation of the working fluid and the cooling fluid through each of the cooling heat exchangers is countercurrent.

2. The device of claim 1, wherein the cooling heat exchangers are situated in the frame next to the common heat exchanger in a direction transverse to the longitudinal axis.

3. The device of claim 1, wherein the two cooling heat exchangers are disposed one above the other in a direction perpendicular to the base.

4. The device of claim 1, wherein the two compressors are disposed in series in the working circuit.

5. The device of claim 1, further comprising at least two drive motors for rotating the compressors each one of which comprises an associated rotary drive shaft that rotatingly drives an associated one of the compressors, wherein:

the expansion mechanism comprising at least one rotary turbine that rotates conjointly with a drive shaft of one of the drive motors; and a refrigeration capacity of the refrigeration device is variable and controlled by a controller that regulates a speed of rotation of the at least two drive motors.

6. The device of claim 1, wherein the cooling heat exchangers are situated adjacently spaced apart from one another by a distance of between 100 mm and 300 mm.

7. A system for refrigeration and/or liquefaction of a flow of user fluid, comprising, a refrigeration device being disposed in a frame and comprising:

a working circuit forming a loop and containing a working fluid, the working circuit forming a cycle that comprises in series: a compression mechanism for compressing the working fluid, a cooling mechanism for cooling the working fluid, an expansion mechanism for expanding the working fluid, and a heating mechanism for heating the working fluid, wherein:

the cooling and heating mechanisms comprising a common heat exchanger through which the working fluid passes in countercurrent in two separate passage portions of the working circuit depending on whether the user fluid is cooled or heated, the compression mechanism comprises two separate compressors, the cooling mechanism comprises two cooling heat exchangers that are disposed respectively at the outlets of the two compressors and ensure heat exchange between the working fluid and a cooling fluid, the frame extends in a longitudinal direction and comprises a lower base configured to be fixed to a support;

the cooling heat exchangers are situated in the frame;

the cooling heat exchangers each have an elongate shape extending in respective longitudinal directions;

each cooling heat exchanger comprises an inlet for working gas to be cooled and an outlet for cooled working gas that are disposed relatively at two longitudinal ends;

each cooling heat exchanger comprises an inlet for cooling fluid and an outlet for cooling fluid;

the two cooling heat exchangers are arranged inversely with respect to one another such that the respective longitudinal directions of the two cooling heat exchangers are parallel or substantially parallel and the directions of circulation of the working fluid in said cooling heat exchangers are opposite to one another;

the cooling heat exchangers are situated adjacently spaced apart from one another by a distance of between 0 mm and 500 mm;

the cooling heat exchangers of elongate shape extend in longitudinal directions that are parallel to the longitudinal axis, the outlet for cooling fluid of one of the cooling heat exchangers is connected to the inlet for cooling fluid of the other cooling heat exchanger such that some of the flow of cooling fluid passing through one of the cooling heat exchangers has already circulated in the other cooling heat exchanger; and a refrigeration heat exchanger intended to extract heat at at least one member by heat exchange with the working fluid circulating in the working circuit, wherein the two cooling heat exchangers are disposed side-by-side or one above the other in a direction perpendicular to the base, wherein a direction of circulation of the working fluid and the cooling fluid through each of the cooling heat exchangers is countercurrent;

at least one tank of user fluid; and a duct for circulation of said flow of user fluid in the cooling exchanger.

* * * * *